US005454673A

United States Patent [19]

DiMartino

[11] Patent Number: 5,454,673

[45] Date of Patent: Oct. 3, 1995

[54] HORIZONTAL CONNECTOR FOR SHIPPING CONTAINERS

[76] Inventor: John M. DiMartino, 824 Hwy. 101, Havelock, N.C. 28532

[21] Appl. No.: 144,353

[22] Filed: Nov. 1, 1993

[51] Int. Cl.[6] ..... B65G 1/14

[52] U.S. Cl. ..... 410/79; 24/287; 410/95

[58] Field of Search ..... 410/79, 78, 77, 410/82, 90, 94, 95; 52/79.9; 220/1.5, 23.4; 24/287

[56] References Cited

U.S. PATENT DOCUMENTS

| | | | |
|---|---|---|---|
| 3,365,229 | 1/1968 | Mitch et al. | 220/23.4 X |
| 3,578,374 | 5/1971 | Glassmeyer | 410/79 X |
| 3,599,824 | 1/1971 | Pneuman et al. | 220/23.4 |
| 3,972,439 | 8/1976 | DiMartino | 410/79 X |
| 3,973,684 | 8/1976 | DiMartino, Sr. | 52/79.9 X |
| 4,942,975 | 7/1990 | Capron et al. | 220/1.5 X |

*Primary Examiner*—Michael S. Huppert
*Assistant Examiner*—James Eller
*Attorney, Agent, or Firm*—Marvin Feldman

[57] ABSTRACT

A horizontal connector interconnects adjacent ISO shipping containers. The connector has oppositely disposed locking arms which engage the inside surfaces of the respective container corner fittings. A push block assembly moves in a first direction to rotate the locking arm to engage the inside surface of a corner fitting, and then a reactive force from the surface engagement causes the push block to move in a second direction angularly disposed to the first direction to in turn cause push block surfaces to be frictionally engaged to lock the arm to the corner fitting. This locking action permits the containers to remain securely interconnected even when the connector and containers are subjected to excessive vibrations.

18 Claims, 4 Drawing Sheets

10
11
12
15
16
17
18
19
20
21
22
25
26
28
29
30
31
32
33
34
63
64
65
66
69
70
72
80
87
88
89
91
2

HORIZONTAL CONNECTOR FOR SHIPPING CONTAINERS

FIELD OF THE INVENTION

This invention relates to connectors for connecting shipping containers.

BACKGROUND OF THE INVENTION

The use of ISO shipping containers has proliferated over the past several years. These standardized shipping containers are provided with corner fittings, in which an orifice is formed in each face of the fitting with the orifices opening into a common recess within the corner fitting.

The art sought to utilize these corner fittings to selectively interconnect the shipping containers. One attempt to provide connectors for these corner fittings is disclosed in U.S. Pat. No. 3,972,439, granted Aug. 3, 1976 to John M. DiMartino (also referred to as the "DiMartino patent"). That prior art construction, while solving the problem of corner fittings container interconnection, did not provide the most desired level of clamping and locking forces so as to provide a secure interconnection even when the connector and containers are subjected to excessive vibrations.

SUMMARY OF THE INVENTION

The present invention is an improvement over the horizontal connector as shown and described in the DiMartino patent. Specifically, the present invention provides improved clamping construction and forces over that provided by the construction shown and described in the DiMartino patent.

The present invention provides a body with locking elements or arms with contours and surfaces configured so that actuation of the push block causes the locking arms to be held against the inside surfaces of the recesses of adjacent container corner fitting. The reactive force caused by the locking arm engagement of the corner fitting surface, in turn causes the push block to change its direction of movement and be cocked to a locked position, with portions of the push block frictionally engaged in the locked position. The clamping or locking forces generated by the connector of the present invention are considerably greater than was achieved by the construction of the DiMartino patent. This improved construction permits the interlocked containers to remain securely interlocked even under conditions where the containers and connector are subjected to excessive vibrations when in use.

DESCRIPTION OF THE PREFERRED EMBODIMENTS

Figure 1:
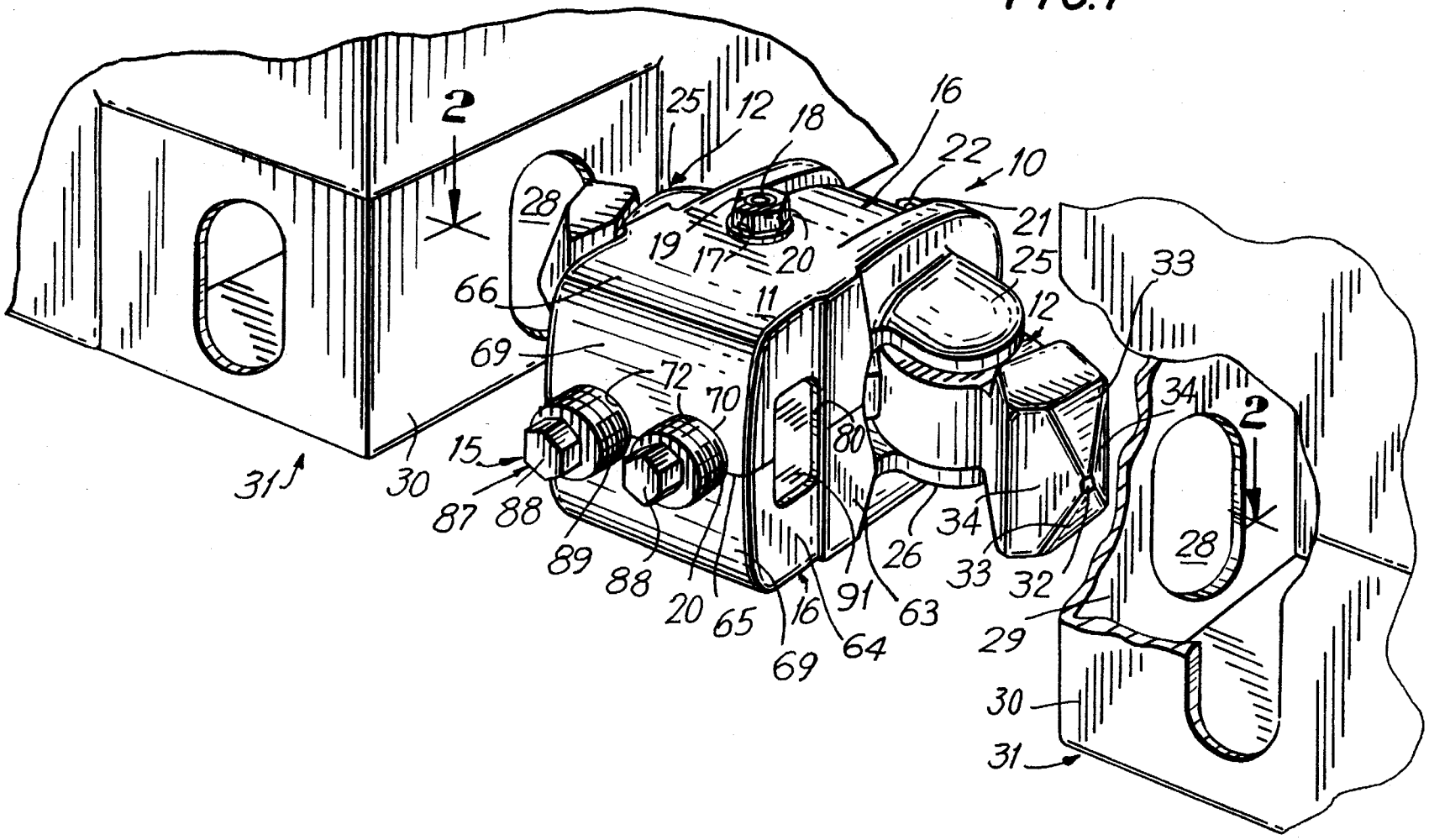
FIG. 1 is a perspective view of the horizontal connector of the present invention disposed between opposed corner fittings of ISO shipping containers.

For a complete understanding of the present improvement, reference is made to U.S. Pat. No. 3,972,439, granted Aug. 3, 1976, which disclosure is incorporated herein by reference thereto.

With references to the FIGS., the connector 10 of the present invention is, in general terms, formed of a body 11, two similar oppositely disposed members or arms 12, respective pivot members 13 for rotationally movement of arms 12 about axes 14, and respective similar push block assemblies 15, as will be further described hereafter.

Body 11 is formed of two symmetrical opposed body members 16. A through hole 17 is formed in the body members and a connecting rod 18 with threaded end 19 and nut 20 hold the members 16 together. Nut 21 and bolt 22 pass through hole 23 to additionally create integral body 11 of opposed facing members 16.

Body members 16 are formed with oppositely disposed pairs of opposed flanges 25 and 26. A pivot or pivot member 13 is disposed between each pair of flanges for rotatable movement of arms 12. Each arm 12 is sized and formed to pass through elongated orifice 28 and engage inner surface 29 of corner fitting 30 of opposed ISO shipping containers 31.

Each arm 12 is formed with a rounded end 32, oppositely disposed triangular end faces 33, oppositely disposed trapezoidal end faces 34, a rear flat planar portion 35 which extends to curved surface 36, which in turn extends to surface 37, and end surface 38. End surface 38, at rounded edge 39, begins engagement with push block engagement surface 40. Surface 40, importantly, is formed with cylindrical concave surface 41 which extends to integral protruding portion 42 having rounded edge 43. Surface 44 and recess 45 extend to form surface 46 which is oppositely disposed to curved surface 36. Surface 46 extends to form recess 47. Flat planar container engagement surface 50 extends from recess 47 to one trapezoidal end face 34. Arm 12 is also formed with upper and lower connecting surfaces 51 and 52. A countersunk portion 53 and through hole 59, are formed in arm 12 to rotatably receive pivot or pivot member 13. Part 12 is integrally interconnected to opposed flange pairs 25 and 26.

Figure 4:
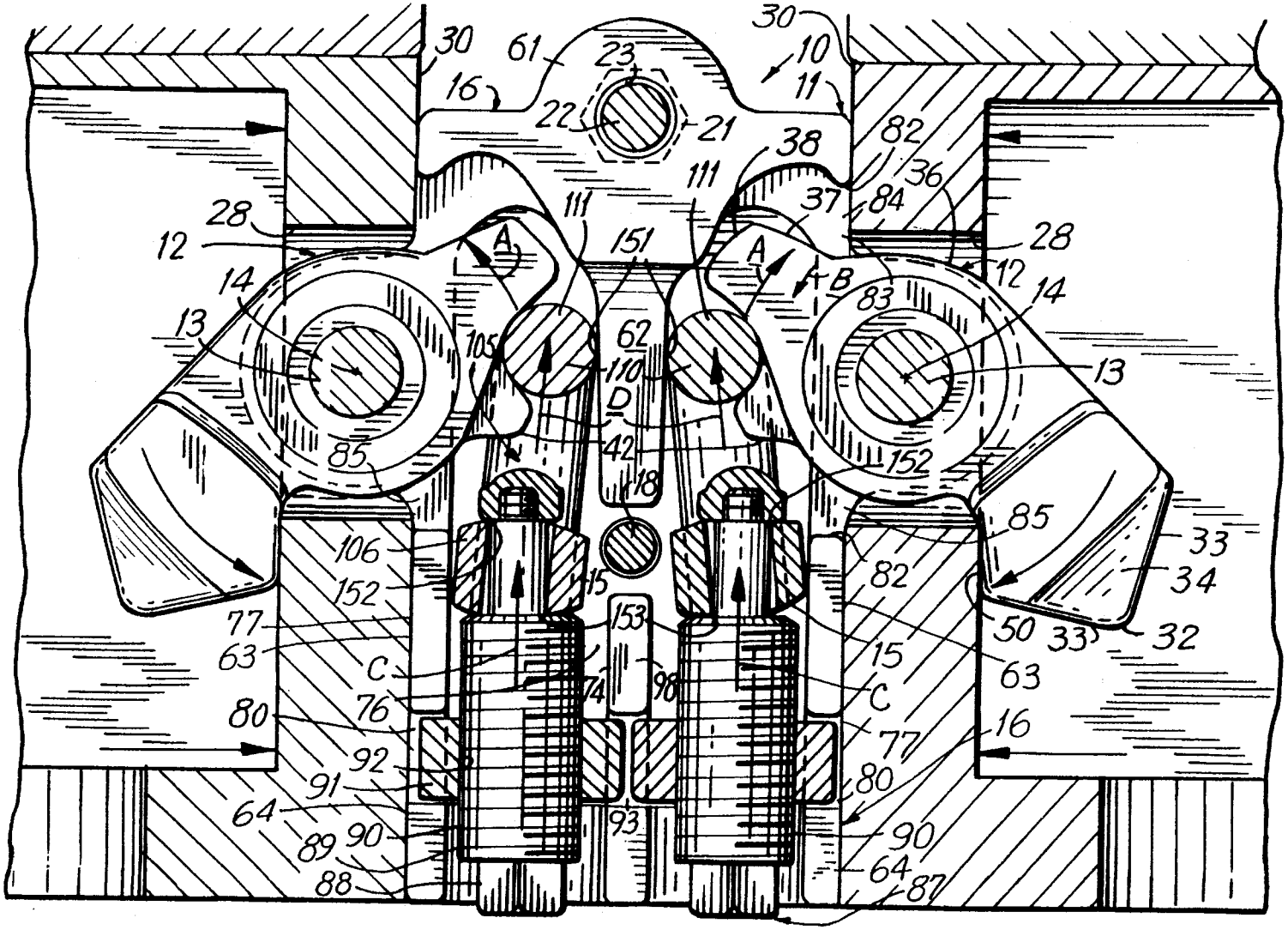
FIG. 4 is a sectional view as shown in FIG. 3, but with the connector locked and interconnected to the opposed shipping containers.

The head 60 of arm 12 is formed at end 12 and is comprised of surfaces 33, 34, 35, 47 and 50. Head 60 is sized to be freely moved through orifice 28 of container 31, when arm 12 is pivoted about pivot member 13 and axis 14. Orifice 28 is elongated with opposed parallel edges 57 and opposed curvilinear edges 58. Head 60 is readily received and rotated within orifice 28 of corner fitting 30. When arm 12 is rotated fully in the direction of arrow A, the arm flat planar surface 50 frictionally engages corner fitting inner surface 29, as best shown in FIG. 4, as will be more fully discussed hereinafter.

Body members 16 are formed with mating planar faces 61, and flat planar surfaces 62, 63, 64 and 65. Body member 16 is also formed with outer face 66 having through hole 17 and flange portion 68 with through hole 23, in which threaded rod 18 and bolt 22 interconnected members 16, as previously described. Outer surface 66 extends to bottom surfaces 69 which meet at edge 65. A pair of semicylindrical edge surfaces 70 are formed in mating members 16 to form a pair of holes 72. Holes 72 extend to cylindrical cavity 73, which extends to curvilinear recess portion 74 and 75. The hole 72, cavity 73 and recess portion 74 and 75 form body recess 76 for receiving push block assembly 15. Each arm 12 is separately actuated by one of the push block assemblies 15.

Body members 16 are formed with side surfaces 77 which mate with surfaces 63 and 64. A half rectangular cut out or edge 78 is formed in each member 16 to form rectangular slot 80. Slot 80 extends from side surfaces 77 to cylindrical surface 81 at cavity 73. A slot 93, corresponding to slot 80, is formed at mating planar flat surfaces 98 by and within mating body members 16. Members 16 have opposed facing curved edges 82 which form enlarged orifice 83, which forms openings 84 and 85 through which arms 12 are spacedly disposed. Flanges 25 and 26 extend from and are integrally formed with side surfaces 77.

Push block assembly 15 is formed of end portion 87 with hex nut 88 and body portion 89. Body portion 89 has external threads 90, and lock bar 91 with internal threads 92 is operably engaged with external threads 90. Bar 91 extends into slot 80 and slot 93. Clearances 94 and 95 are provided between bar 91 and body members 16. Bar 91 holds push block assembly 15 in body 11. Push rod 100 extends upwardly from threaded body portion 89 and is formed with cylindrical portion 101, and threaded end 102 with threaded cap 103. A pushblock 105 is formed with a collar 106 and is spacedly disposed at 107 and surrounds cylindrical rod portion 101. A pair of vertically, parallel disposed members 108 are formed with and at opposite sides of collar 106 and extend upwardly from the collar. A cross-bar 110 of cylindrical cross-section 111 is horizontally disposed and interconnects members 108 to complete the construction of push block 105. Locking arm push block engagement part cylindrical surface 104 is sized and contoured to contact more than 90° of the cylindrical surface of cross-bar 110. The locking arm/cross-bar contact surfaces 150, are best shown in FIG. 4.

Figure 2:
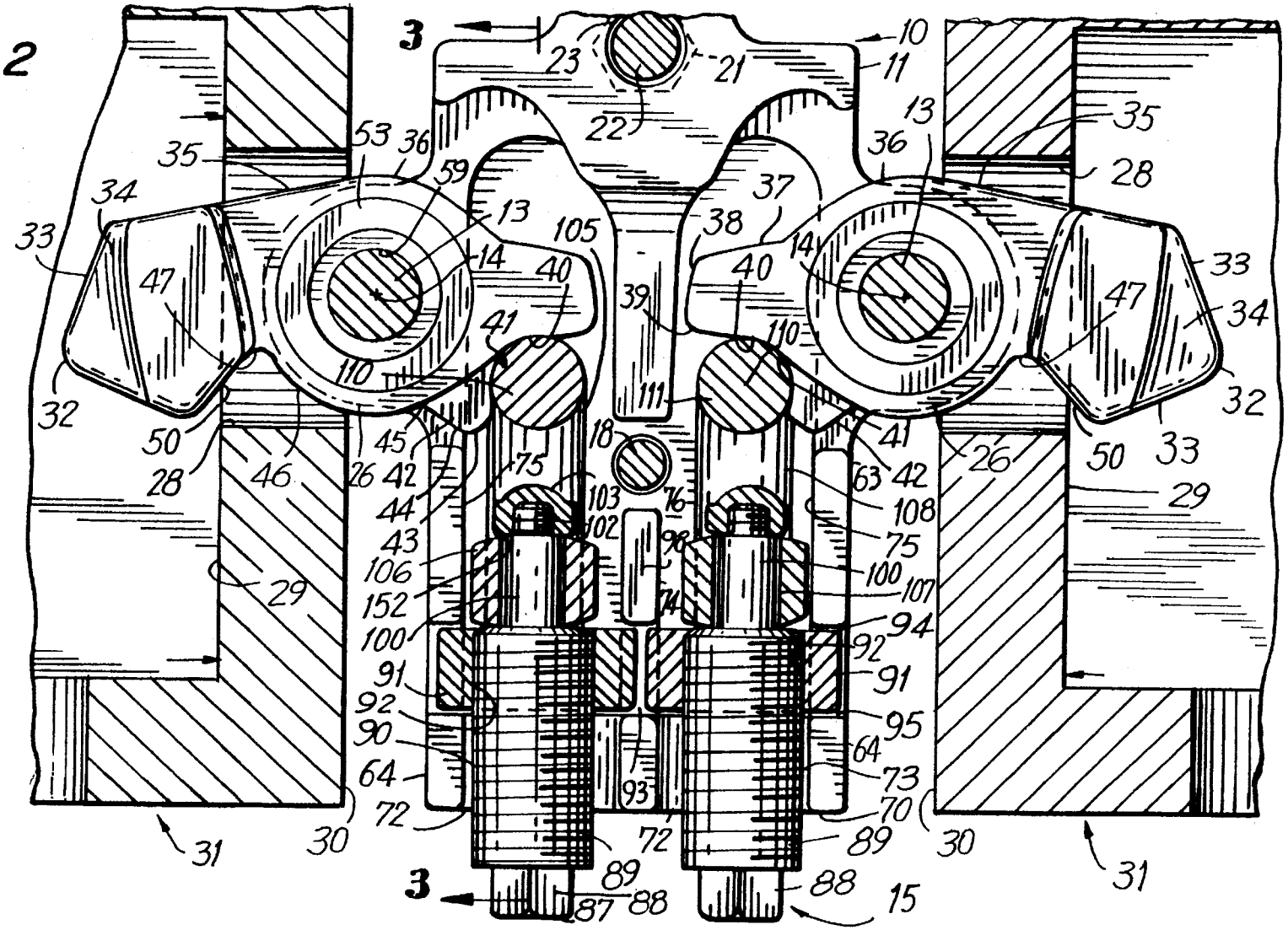
FIG. 2 is an enlarged sectional view taken along line 2—2 of FIG. 1, showing the connector locking arms disposed within the respective openings of the opposed corner fittings, but with the connector unconnected to the containers.
Figure 3:
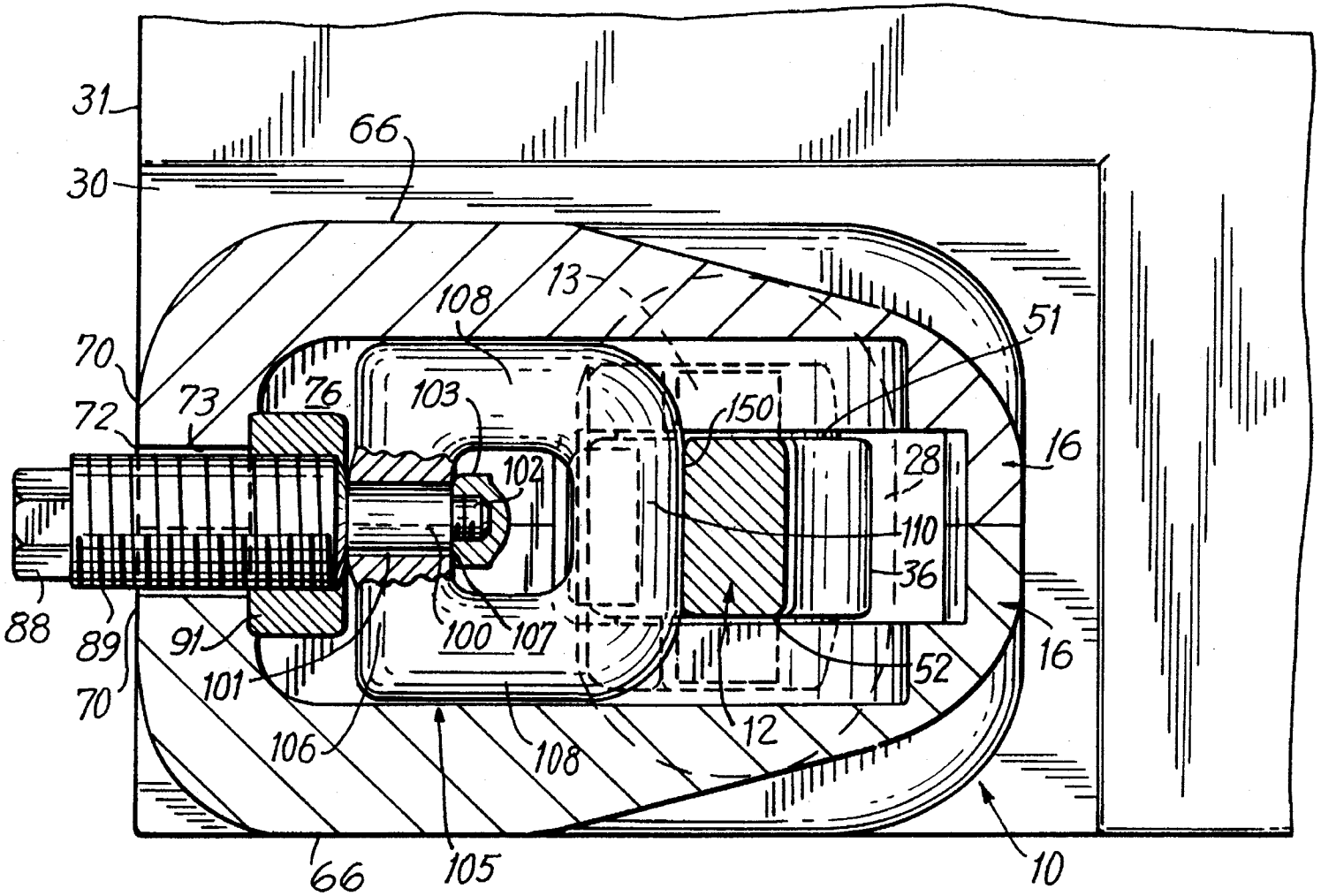
FIG. 3 is a sectional view taken along line 3—3 of FIG. 2.

By means of the aforesaid construction, the connector is operated by placing the connector between two adjacent containers 31, with one locking arm 12 disposed within the recess of the more adjacent container, as demonstrated in FIG. 2. The user then by means of a wrench engages end hex nut 88 and screws body portion 89 in lock bar 91 so as to drive cross-bar 110 in the direction of arrow C into surface engagement with locking arm 12, to cause locking arm 12 to rotate in the direction of arrow A. Rotation of locking arm 12 continues until there is full engagement of arm planar surface 50 with corner fitting planar surface 29, at which time a reactive force through arm 12 causes cross-bar 110 and in turn push block 105 to move in a direction angularly disposed (i.e., in the direction of arrow D) from the upward direction (i.e., the direction of arrow C) so that the push block 105 is angularly disposed or cocked. In this cocked position, the forces cause frictional engagement at the cross-bar/body contact surfaces 151, the collar/push rod upper contact surfaces 152, the collar/push rod lower contact surfaces 153, as well as the aforediscussed locking arm/cross-bar contact surfaces 150. The arm 12 is thus locked to the corner fitting 29. This procedure is repeated to locked the other arm 12 to the other adjacent container, which container is moved into position juxtaposed to the other arm 12, after the aforesaid first arm 12 is locked into place. To unlock the connector, the operator simply engages end hex nuts 88 to rotate the push rods in the opposite direction to lower the push block assemblies 15 and, in turn, cause arms 12 to rotate in the direction of arrow B and away from the corner fittings.

By means of the aforesaid construction, the locking arm is locked in place with the containers interconnected. The clamping or locking force that is achieved maintains the locked position even where there are substantial vibrations. This high degree of locking is achieved by the reactive force causing the push block to be cocked or wedged within the body. There are four sets of surfaces in frictional engagement which create this locked condition, namely, the locking arm/cross bar contact surfaces 150, cross bar/body contact surfaces 151, collar/push rod upper contact surfaces 152, and collar/push rod lower contact surfaces 153.

To release the locking arm from the locked position, the push pin is unscrewed away from the body, causing the locking arm to pivot in the direction opposite to that in blocking the arm, and thereby the configuration of the connector is changed from that shown in FIG. 4 to the unlocked a condition shown in FIG. 2.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the invention as set out in the appended claims.

What I claim is:

1. A connector for releasably coupling a pair of adjacent corner fittings of cargo containers, said corner fittings having an inner recess accessible through an orifice formed on the respective sides thereof, said connector comprising;

body means having a first arm, said first arm having a first surface for engaging an inner surface which forms the recess of the corner fitting with said first arm disposed through said corner fitting orifice, said body means further comprising first means for pivoting said first arm, said first arm having a second surface, with said first means for pivoting disposed between said first and second surfaces, first push block means for moving in a first direction for engaging said first arm second surface, whereby said first push block means engages the second surface to pivot the first arm, said first push block means comprising means for movement in a second direction angularly disposed to said first direction to an angular disposition, and said first push block means and said body means having surface means for frictional engagement with each other when in the angular disposition, whereby with movement of said first push block means, said first arm is pivoted so that said first arm first surface engages the corner fitting inner surface, and said first push block means then reacts to the first arm surface engagement and moves in the second direction for said frictional engagement of the first push block means and body means to lock the connector first arm to the corner fitting, and said body means having a second arm having first and second surfaces, with second means for pivoting said second arm, and second push block means, said second arm, second means for pivoting, and second push block means comprising means and being operable in the manner of said first arm, said first means for pivoting and said first push block means, respectively, with said second arm disposed within a corner fitting of an adjacent shipping container, whereby with the locking of said first and second arms in said adjacent corner fittings, the shipping containers are interconnected and locked together, each said first arm and second arm second surface comprising a first portion and a second portion, each respective push block means first engaging said first portion with said pivoting of each said arm, and with each said arm first surface engagement of the corner fitting there is said movement of the respective push block means in said second direction with said respective push block means then engaging said second portion to achieve said frictional engagement of the respective push block means and the body means.

2. The connector of claim 1, each said arm second surfaces being formed so as to frictionally engage said respective push block means, so that with the reactive force said arm at said second surface causes said push block means to move in said second direction.

3. The connector of claim 2, each said push block means comprising rod means and collar means spacedly disposed on said rod means, said collar means and rod means comprising second surface means for frictional engagement for locking each said respective arm.

4. The connector of claim 3, each said push block means and each said body means comprising means for said frictional engagement of the push block means second surface for locking each said respective arm.

5. The connector of claim 4, each said respective arm first surface comprising a flat planar surface, and each said corner fitting inner surface comprising a flat planar surface, so that each said respective arm surface and corner fitting planar surface are in frictional engagement with the locking of the arm to the respective corner fitting.

6. The connector of claim 3, means for integrally connecting said collar means and said rod means.

7. The connector of claim 6, each said collar means comprising an inner surface and said rod means comprising an outer surface, and wherein said collar means inner surface and said rod means outer surface comprise said surface means for frictionally engaging the push rod means with the arms locked.

8. The connector of claim 7, said rod means outer surface and said collar means surface being formed for frictional engagement at two spacedly disposed points.

9. The connector of claim 2, each said push block means comprising a cross bar portion, each said cross bar portion comprising a cylinder having a cylindrical surface.

10. The connector of claim 9, each said arm second surface being formed so as to frictionally engage more than a 90 degree portion of said cylinder cross bar portion cylindrical surface.

11. The connector of claim 9, each said cross bar portion cylindrical surface and said respective body means comprising said surface means for frictional engagement, with the arms locked.

12. The connector of claim 11, each said arm first surfaces comprising a flat planar surface, and each said corner fitting inner surface comprising a flat planar surface, so that said respective arm and corner fitting planar surfaces are in frictional engagement with the locking of the arms to the respective corner fittings.

13. The connector of claim 2, each said push block means comprising at least two opposed surfaces for said frictional engagement for locking each arm.

14. The connector of claim 1, said respective arm second surfaces being formed so as to frictionally engage said respective push block means, so that with the respective reactive force, said arm causes said respective push block means to move in said second direction.

15. The connector of claim 1, each said first portion comprising a curved surface and said second portion comprising a flat surface.

16. A connector for releasably coupling a pair of corner fittings of adjacent cargo containers, said corner fittings having surfaces forming a recess, said recess being accessible through an orifice formed on the respective sides thereof, said connector comprising;

body means having arm means, said arm means having two first surfaces for engaging the respective surfaces forming the respective recess of the corner fittings of the adjacent cargo containers, with said arm means disposed through said corner fittings orifices, said body means further comprising means for pivoting said arm means, said arm means being formed with two second surfaces spacedly disposed from said respective first surfaces, with said means for pivoting disposed between said respective first and second surfaces, push block means and means for moving said push block means in a first direction for engaging said arm means respective second surfaces, whereby said push block means engages the respective second surface causing the arm means to pivot in the respective container orifice, said push block means further comprising means, with the arm means engaging the corner fitting, for moving the push block means in a second direction angularly disposed to said first direction to an angular disposition, and wherein said push block means and said body means having surface means for frictional engagement when in the angular disposition, whereby with said movement of said push block means, said arm means is pivoted so that said arm means respective first surface engages the respective corner fitting surface and said push means block means through the reactive force of the arm means first surface engagement with the corner fitting surface, moves in the second direction to said angular disposition for said frictional engagement of the push block means and body means to lock the arm means to the corner fitting to connect one of the containers, each said arm means second surface comprising a first portion and a second portion, said push block means first engaging said first portion with said pivoting of said arm means, and with said arm means first surface engagement of the corner fitting there is said movement of the push block means in said second direction with said push block means then engaging said second portion to achieve said frictional engagement of the push block means and the body means.

17. The connector of claim 16, said push block means being formed with rod means and collar means spacedly disposed on said rod means, said collar means and rod means comprising second surface means for frictional engagement for locking said arm means to the corner fitting.

18. The connector of claim 16, said first portion comprising a curved surface and said second portion comprising a flat surface.

* * * * *